United States Patent [19]

Yoneya

[11] 4,009,541

[45] Mar. 1, 1977

[54] UNDER-ROOF DRAINAGE DEVICE

[75] Inventor: Kiyoo Yoneya, Kurobe, Japan

[73] Assignee: Yoshida Kogyo Kabushiki Kaisha, Tokyo, Japan

[22] Filed: Apr. 23, 1976

[21] Appl. No.: 679,847

[30] Foreign Application Priority Data

Apr. 24, 1975 Japan ..... 50-56516[U]

[52] U.S. Cl. ..... 52/14

[51] Int. Cl.[2] ..... E04D 13/00

[58] Field of Search ..... 52/13, 14, 15, 11, 18, 52/584

[56] References Cited

UNITED STATES PATENTS 3,970,402 7/1976 Yamashita ..... 52/584 X

FOREIGN PATENTS OR APPLICATIONS 381,406 10/1964 Switzerland ..... 52/13

128,927 6/1919 United Kingdom ..... 52/13

*Primary Examiner*—Price C. Faw, Jr.

*Assistant Examiner*—Carl D. Friedman

*Attorney, Agent, or Firm*—Hill, Gross, Simpson, Van Santen, Steadman, Chiara & Simpson

[57] ABSTRACT

An under-roof drainage device for draining moisture condensation on the undersurface of a roof or ceiling. The device comprises a plurality of elongated unit panels each having a longitudinal central portion dividing the unit panel into a pair of panel sections with opposite free edges, the panel sections each being sloped downwardly from the central portion toward the free edge. A male half member extends downwardly from the free edge of the panel section. There are also provided a plurality of gutter means each having the same length as the unit panel and including a female member formed centrally on and extending along the gutter means. The adjacent unit panels provide mated male half members detachably interfitting with the female member on the gutter means. The assembled device is mounted beneath a roof, or used as a ceiling with the gutter means inclined relative to the horizontal for the drainage.

6 Claims, 2 Drawing Figures

FIG. 1
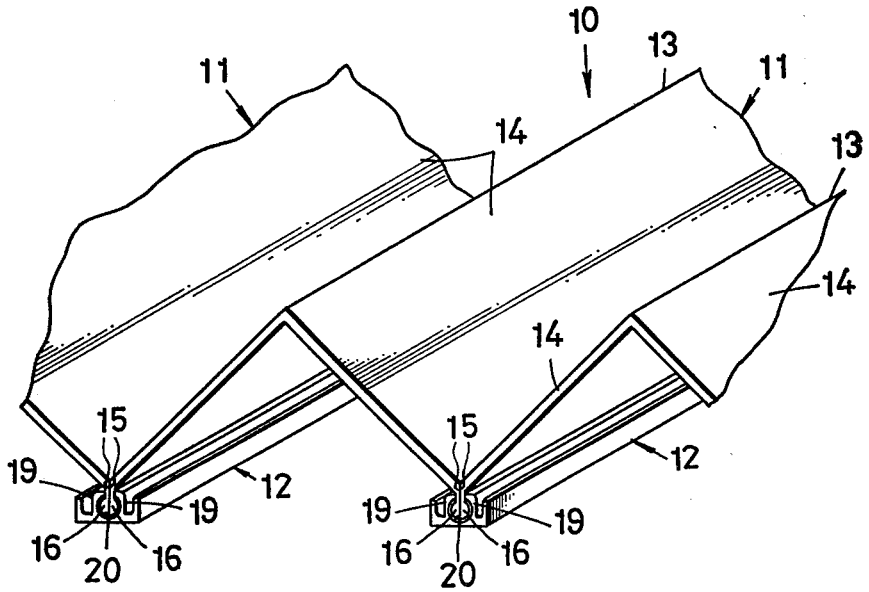
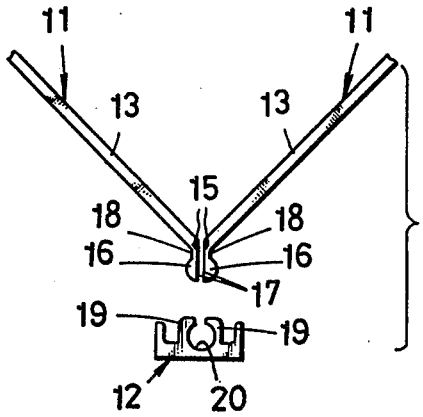
FIG. 2

UNDER-ROOF DRAINAGE DEVICE

BACKGROUND OF THE INVENTION

1. Field of the Invention

This invention relates to a device for draining moisture condensation on the undersurface of a roof or ceiling.

2. Description of the Prior Art

It is a well known problem that the undersurface of, for example, a factory roof or bathroom ceiling, when at a temperature below the dew point, causes moisture from the room air to condense thereon, thereby producing dewdrops which tend to fall into the room.

Various attempts have been made to drain the dewdrops thus formed, but have met with only partial success. For example, one such proposal has comprised a plurality of elongated, hollow structural members each having a concave bottom wall with central slits or apertures formed therein. The structural members are interconnected side by side and used as the ceiling of a bathroom, for instance. Humidified room air flows upwardly through the apertures into the hollow members in which condensed moisture is trapped and drained by the bottom wall. This prior art attempt is, however, unable to drain moisture on the underside of the bottom wall. Furthermore, the hollow members are relatively difficult to manufacture.

Another prior effort has included a corrugated panel with a plurality of gutters mounted on the undersides of grooves of the panel. This effort has a drawback, however, in that it is difficult to attach the gutters, and to clean them once they are assembled.

SUMMARY OF THE INVENTION

With the above-noted problems in view, it is an object of the present invention to provide an under-roof drainage structure which can be assembled and disassembled with maximum ease.

Another object of the present invention is to provide an underroof drainage device for draining moisture on the undersurface of a roof or ceiling without fail.

According to the invention, an under-roof drainage device comprises a plurality of unit panels of extended length each having a longitudinal central portion dividing the unit panel into a pair of panel sections with opposite free edges. The panel sections are each sloped downwardly from the central portion toward the free edge. A male half member extends downwardly from each free edge of the panel section. There are provided channel-shaped gutters each having the same length as the unit panel and a female member formed centrally on and extending along the gutter. The adjacent unit panels when coupled together provide mated male half members interengageable with the female member on the gutter.

Many other advantages and features of the present invention will become manifest to those versed in the art upon making reference to the detailed description and the accompanying sheet of drawings in which a preferred embodiment incorporating the principles of the present invention is shown by way of illustrative example.

BRIEF DESCRIPTION OF THE DRAWINGS

FIG. 1 is a fragmentary perspective view of an under-roof drainage device constructed in accordance with the invention; and FIG. 2 is a fragmentary exploded front elevational view of the under-roof drainage device shown in FIG. 1.

DESCRIPTION OF THE PREFERRED EMBODIMENT

In FIG. 1, there is shown an under-roof drainage device generally indicated by the numeral 10 and comprising a plurality of unit panels 11 of extended length and a plurality of gutters or gutter means 12 having the same length as the unit panels 11 and detachably secured to the unit panels 11. Each of the unit panels 11 has a longitudinal central portion 13 dividing the unit panel 11 into a pair of panel sections 14, 14 with oppositely facing free edges 15. Each of the panel sections 14 is sloped downwardly from the central portion 13 toward its free edge 15. While each unit panel 11 is shown to be of an inverted V-shaped cross-section, it may be of an arcuate cross-section.

A male half member 16 extends vertically downwardly from each of the free edges 15 of the unit panel section 14. The male half member 16 has a flat outer furface 17 held in mated relationship with that of the male half member 16 of the adjacent unit panel 11. The adjacent male half members 16, when mated together, provide a substantially circular cross-section. The male half member 16 is coupled with the free edge 15 by a neck portion 18 of a reduced thickness.

Each gutter means 12 has a channel-shaped cross-section and has a pair of spaced hook-shaped projections 19 formed integrally therewith. The projections 19 jointly define a female member having a cylindrical groove 20 complemental in cross-section to and receptive of the mated male half members 16. The gutter means 12 is preferably made of plastic to render the projections 19 flexible enough for the mated male members 16 to be snapped into the groove 20.

When the under-roof drainage device 10 is to be assembled, the adjacent unit panels 11 are first held against each other at the flat surfaces 17 of the male members 16. The gutter means 12 are then attached to the combined unit panels 11 by fitting the hook-shaped projections 19 snappingly over the mated male half members 16, in order to connect the unit panels 11 together. The assembled device 10 is mounted beneath a roof, or used as a ceiling with the gutter means 12 inclined relative to the horizontal for drainage.

With this construction, dewdrops produced by moisture accumulated on the entire undersurface of the unit panels 11 flow along the inclined panel sections 14 into the gutter 12. Furthermore, the gutter means 12 serve to couple the adjacent unit panels 11 together.

Although various minor modifications may be suggested by those versed in the art, it should be understood that I wish to embody within the scope of the patent warranted hereon, all such embodiments as reasonably and properly come within the scope of my contribution to the art.

What I claim as my invention:

1. An under-roof drainage device comprising in combination:

a. a plurality of unit panels of extended length each having a longitudinal central portion dividing said unit panel into a pair of panel sections with oppositely facing free edges, said panel sections each being sloped downwardly from said central portion toward said free edges:

b. a male half member extending donwardly from at least one of said free edges of each of said unit panels, and engaging the male half member of the adjacent unit panel; and c. at least one gutter means having the same length as the unit panels and including a female member formed centrally on and extending along the length of said gutter means, said engaging male half members detachably interfitting with said female member on said gutter means.

2. An under-roof drainage device according to claim 1, said gutter means being of a channel-shaped cross-section.

3. An under-roof drainage device according to claim 1, in which said engaging male half members are jointly of a substantially circular cross-section and said female member has a pair of spaced projections formed integrally with said gutter means, said projections defining together a groove complemental in cross-section to said engaging male half members.

4. An under-roof drainage device according to claim 1, at least one of said unit panels having an inverted V-shaped cross-section.

5. An under-roof drainage device according to claim 1, in which said male half member has a flat surface held in mated relationship with that of the male half member of the adjacent unit panel.

6. An under-roof drainage according to claim 1, said gutter means being made of plastic.

* * * * *